United States Patent [19]

Hirauchi et al.

[11] Patent Number: 4,549,523

[45] Date of Patent: Oct. 29, 1985

[54] HEATING APPARATUS

[75] Inventors: Yukio Hirauchi, Nara; Kazuhiro Nakano, Nabari; Toyohei Harada, Nara, all of Japan

[73] Assignee: Matsushita Electric Industrial Co., Ltd., Osaka, Japan

[21] Appl. No.: 647,274

[22] Filed: Sep. 4, 1984

Related U.S. Application Data

[63] Continuation of Ser. No. 345,545, Feb. 3, 1982, abandoned.

[30] Foreign Application Priority Data

| | | | |
|---|---|---|---|
| Feb. 12, 1981 | [JP] | Japan | 56-19881 |
| Feb. 23, 1981 | [JP] | Japan | 56-25875 |
| Feb. 23, 1981 | [JP] | Japan | 56-25876 |
| Feb. 23, 1981 | [JP] | Japan | 56-25877 |

[51] Int. Cl.[4] ..... F24C 5/06; F24C 3/04

[52] U.S. Cl. ..... 126/97; 126/93; 126/62; 362/92

[58] Field of Search ..... 126/93, 97, 96, 95, 126/62, 86, 294, 58; 362/92, 89, 221

[56] References Cited

U.S. PATENT DOCUMENTS

| | | | |
|---|---|---|---|
| 1,529,408 | 3/1925 | Coleman | 126/95 |
| 2,011,982 | 8/1935 | Richardson | 126/97 |
| 2,016,722 | 10/1935 | Levin | 362/89 |

FOREIGN PATENT DOCUMENTS

| | | | |
|---|---|---|---|
| 2057739 | 11/1970 | Fed. Rep. of Germany | 126/97 |
| 452255 | 5/1913 | France | 126/97 |
| 6569 | of 1888 | United Kingdom | 126/97 |
| 17609 | of 1899 | United Kingdom | 126/97 |
| 0835420 | 5/1960 | United Kingdom | 126/97 |

*Primary Examiner*—Samuel Scott
*Assistant Examiner*—Helen A. Odar
*Attorney, Agent, or Firm*—Stevens, Davis, Miller & Mosher

[57] ABSTRACT

This invention relates to a heating apparatus such as an oil heater, a gas heater or an electric heater generating heat and light, and to provide an arrangement such that at least a part of periphery of a heat source of the heating apparatus is covered with a netlike member and the netlike member is arranged to be wrapped therearound so that the meshes of the net apparently overlap each other at the front and rear sides of the heat source, thus improving both heating and illuminating effects.

7 Claims, 7 Drawing Figures

HEATING APPARATUS

This application is a continuation, of application Ser. No. 345,545, filed 02/03/82, now abandoned.

This invention relates generally to a heating apparatus, and more particularly, to a heating apparatus utilizing a heat source for both heating and illumination.

More specifically, the present invention provides a heating apparatus such as an oil heater or a gas heater, in which at least a part of the periphery of a heat source for the heating apparatus is covered with a net-like member so as to effectively permit both heating and illumination by utilizing heat and light generated from the heat source.

Conventionally, there has been employed a heating apparatus which produces heating and illumination by making use of heat and light generated from a heat source, the heating apparatus being typically arranged such that the periphery of a combustion portion serving as the heat source is surrounded by a transparent glass tube. The heating apparatus of this kind has the advantage of not only effecting convection heating with exhaust gas from the combustion portion and radiation heating with radiant heat transmitted through the glass tube from the combustion portion, but also permits illumination by the use of the light emitted from the combustion portion and then radiated through the glass tube. According to a thus arranged heating apparatus, there is obtained still another advantage which is that the light from the combustion portion is reflected several times at the inner surface of the glass tube and two images of a ring-like burning flame are produced in the vertical direction, thus leading to a superior lighting effect.

In the heating apparatus as mentioned above, however, since radiant heat from the combustion portion is directly utilized for heating, a problem has been encountered in that a wide range and soft heating effected by indirect radiant heat can not be obtained. Moreover, since there is a glaring light from the combustion portion due to direct radiation thereof, the user's eyes are dazzled by the glare and the user feels the light dangerous rather than as an effective illumination source, thus making such a prior heating apparatus unfavorable to the user to some degree.

To solve the above stated problem of direct radiation heating, glare and so on, there has been also proposed another heating apparatus in which the periphery of the combustion portion is surrounded by an opaque glass tube, or an enameled perforated tube (which is obtained by covering a perforated tube with enamel having minute holes covered with enamel so as to provide a milk white color). In this case, however, heating at an area near the tube surrounding the combustion portion is effected only by indirect radiation heating, and direct heating with radiant heat does not contribute to the process of such heating, thus resulting in a problem that the user has an unsatisfied feeling concerning the total heating effect. In addition, a still further problem has been encountered in that illumination at a sufficient level can not be obtained, because most of the light emitted from the combustion portion is interrupted by the surrounding tube.

It is an object of the present invention to completely eliminate the above-mentioned problems in the prior art and, therefore, to provide a heating apparatus so arranged that at least a part of the periphery of a heat source is covered with a net-like member, whereby effective mixed heating can be achieved with the combination of direct heat and indirect radiant heat, while allowing illumination to be provided such that it may be used as a mood lamp, too.

BRIEF DESCRIPTION OF THE DRAWINGS

Referring to FIGS. 1 to 4, there is shown a preferred embodiment of the present invention which has been applied to an oil heater, the reference numeral 1 denotes a body of the heater including a fuel tank 2 shaped into a circular or rectangular form; 3 denotes a combustion portion serving as a typical heat source provided above the fuel tank 2, which functions to suck up liquid fuel, for instance, kerosene, from the fuel tank 2 through a cylindrical wick 3*a*, evaporate the sucked-up fuel and then burn it. Upon such combustion, a white yellow flame in the shape of a ring is formed while generating heat and light. Numeral 4 denotes a cylindrical tube surrounding the combustion portion 3, the cylindrical tube being made of transparent or semi-transparent materials such as ceramics, glasses or heat-resistant synthetic resin. Numeral 5 denotes a cylindrical net-like member provided at the periphery of the cylindrical tube 4 surrounding the periphery of the combustion portion. In this preferred embodiment, a lath net with a fairly small mesh size is used as the net-like member and is arranged to be wrapped around the outer surface of the cylindrical tube 4 in such a manner that the meshes of the part of the lath net at the front and rear sides thereof apparently overlap each other when viewed along the horizontal direction. Particularly also in this embodiment, the net-like member comprising a lath net is formed to have meshes of a rhomboid shape and each mesh includes a frame 5*a* inclined upwardly or downwardly and forwardly or rearwardly, the frame 5*a* having the surface electroplated with chromium and finished to have a mirror-like surface. The reference numeral 6 denotes a cover in the form of a disk, which is detachably fitted on the upper end of the cylindrical tube 4 and formed with a plurality of ventilating holes 7 in its peripheral wall. Numeral 8 denotes a guard provided between the cover 6 and the body 1 of the heater so as to surround the periphery of the net-like member, the guard 8 comprising a plurality of wire members and separatively connecting the cover 6 with the heater body 1.

Figure 1:
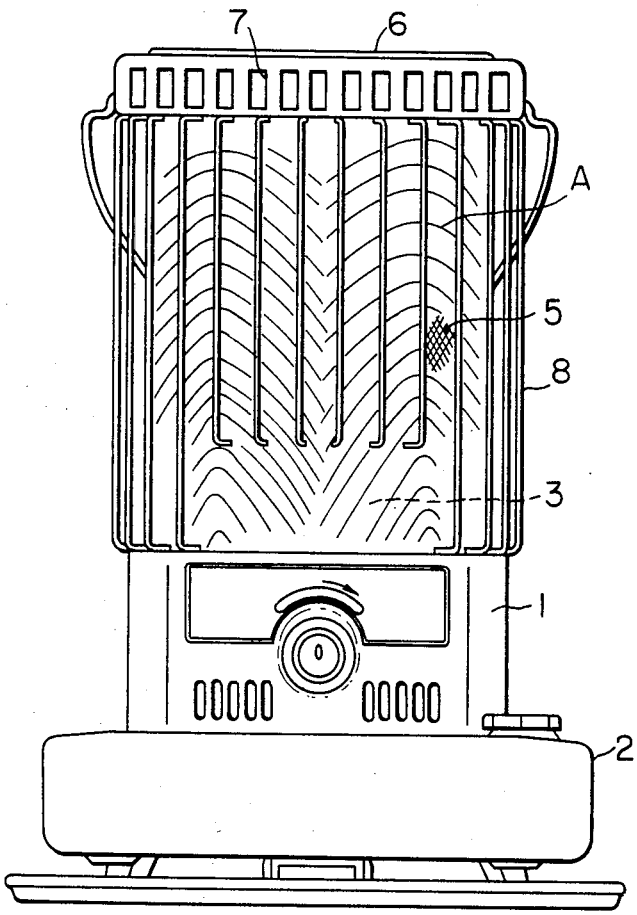
FIG. 1 is a front view of a heating apparatus according to a preferred embodiment of the present invention.

In the arrangement as mentioned above, the mesh frame 5a of the net-like member 5 surrounding the combustion portion 3 is heated by absorbing heat from the combustion portion 3 and therefore becomes high in temperature after a short time. Accordingly, the net-like member 5 serves as a secondary heat source and then emits soft, indirect radiant heat. Meanwhile, the combustion portion 3 surrounded by the net-like member 5 also emits radiant heat directly through an opening of each mesh formed in the net-like member 5, thus effecting direct heating by radiant heat. More specifically, the present heating apparatus can provide mixed heating with the combination of soft, indirect radiant heat from the net-like member 5 and direct radiant heat from the combustion portion 3, so that the user may obtain wide range and gentle heating due to indirect radiant heat, while receiving intense heat due to direct radiant heat. As a result, the user can warm himself without having an unsatisfied feeling or an irritating feeling as experienced from the conventional heating apparatus.

On the other hand, the net-like member 5 surrounding the periphery of the combustion portion 3 allows light to be emitted to the outside through the mesh openings 5b together with the above stated heat from the combustion portion 3. On this occasion, the light from the combustion portion 3 is not entirely emitted to the outside, but partially interrupted by the mesh frames 5a of the net-like member 5 so as to be divided into small shafts of light flux. Therefore, soft light is emitted from the entire region of the net-like member 5 and the thus obtained light does not dazzle the user's eyes.

In the following the major feature of the present invention will be described. The net-like member 5 according to this invention is shaped into a cylindrical form so as to surround the periphery of the combustion portion 3 and is arranged in such a manner that the meshes of the parts of the net-like member 5 at the front and rear sides thereof apparently overlap at the front side and the rear side thereof when viewed along the horizontal direction, thus producing beautiful speckled patterns A due to such overlapping. More specifically, although the net-like member 5 has a continual pattern with an equal pitch, the meshes of the front and rear sides of the net-like member 5 are apparently shifted in their pitches when viewed along the horizontal direction from a little spaced position, because there is caused a difference in parallax because the distances from the user's eyes to the front side and the rear side of the net-like member are different. Accordingly, there is exhibited continually the portions where the mesh openings 5b at the both sides coincide with each other in their locations and hence the mesh frames 5a at the front side conceal those at the rear side, and the portion where the both mesh openings 5b do not coincide and hence the mesh frames 5a at the rear side can be seen through the mesh openings 5b at the front side, thus producing continual speckled patterns A corresponding to a pattern of the net-like member 5.

When the light from the combustion portion 3 extinguished, such speckled patterns A do not appear so clearly because both front and rear side parts of the net-like member 5 are subjected to external light at a nearly uniform level. But when burning is started in the combustion portion 3, the rear side part of the net-like member 5 receives light from the combustion portion 3 and hence shines brightly, while the front side part of the net-like member 5 interrupts the light to be emitted to the outside and hence looks dark, so that the above-mentioned speckled patterns A can be seen more clearly so as to stand out in relief. Moreover, those speckled patterns A are varied by changing a visual point and shine in an orange color by reflecting the light from the combustion portion, thereby producing a remarkably decorative effect while exhibiting a couple of ring-like images of burning flames as stated in the above.

Particularly in this embodiment, since the mesh frames 5a of the net-like member 5 are inclined upwardly or downwardly to make it easy to see the rear side part of the mesh frames 5a reflecting the light from the combustion portion 3 through the mesh openings 5b of the front side part thereof, the speckled patterns A appear more brightly so as to provide a more effective decoration. In addition, the surface of the net-like member 5 is electroplated with chromium and finished to have a mirror-like surface with high reflectivity, so that the light emitted from the combustion portion 3 and striking the rear side part of the net-like member is reflected toward the front side part with high efficiency and speckled patterns of orange color appear still more brightly and clearly.

In this connection, the net-like member 5 can be easily removed by releasing the guard 8 and then the cover 7, and the mesh frames 5a of the net-like member 5 are also inclined forwardly or rearwardly. Therefore, when the cylindrical net-like member 5 is again attached to the periphery of the cylindrical tube 4 as shown in FIG. 1 in the vertically reversed state after once having been removed therefrom, the forward or rearward inclination of the mesh frames 5a is reversed with respect to the previous one, so that the speckled patterns A are changed in the form thereof or a heating effect is varied, accordingly. As a sequence, there can be easily obtained both heating and illuminating effects corresponding to the favorite feeling of the user.

In addition, according to this embodiment, the combustion portion 3 is surrounded by the transparent or semi-transparent cylindrical tube 4 together with the net-like member 5, thereby the light from the combustion portion 3 is reflected several times at the inner surface of the cylindrical tube 4 so as to produce a couple of images of ring-like burning flames in the vertical direction, thus resulting in the advantage that an illuminating effect can be improved significantly. Furthermore, in the heating apparatus utilizing the combustion portion 3 as a heat source, the cylindrical tube 4 provides still another effective advantage in protecting the combustion portion 3 from external draughts, which contribute to accelerated combustion by virtue of the draft effect.

Figure 5:
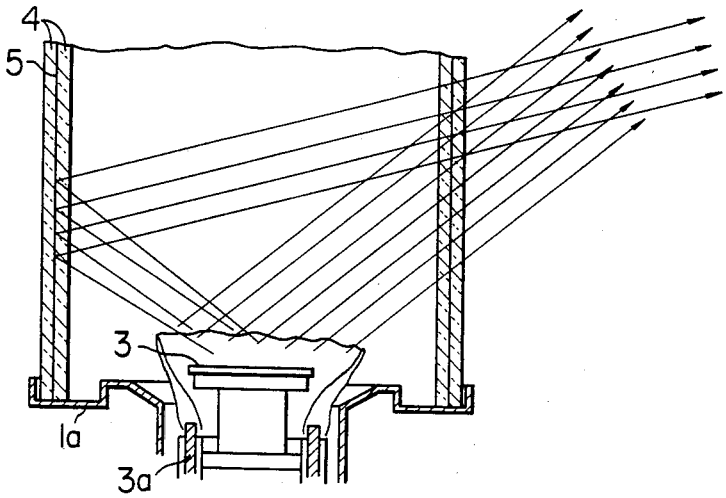
FIG. 5 is an enlarged longitudinal sectional view showing essential parts of a heating apparatus according to another preferred embodiment of the present invention.
Figure 6:
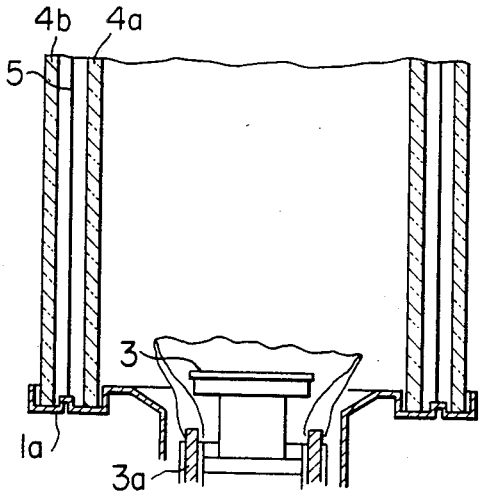
FIG. 6 is an enlarged longitudinal sectional view showing essential parts of a heating apparatus according to still another preferred embodiment of the present invention.

Referring to FIGS. 5 and 6 in which there are shown other preferred embodiments of the present invention. FIG. 6 shows another arrangement where the net-like member 5 used in the foregoing embodiment is embedded in the transparent or semi-transparent cylindrical tube 4, and FIG. 6 shows still another arrangement where the net-like member 5 is located between inner and outer cylindrical tubes 4a, 4b. In either case, there is obtained such advantage in addition to the above-mentioned effects that the mesh frames 5a of the net-like member 5 are not clouded with dust or the like, hence an illuminating effect is not substantially deteriorated even after long use. The embodiment as shown in FIG. 5 can provide the additional advantage that even if the cylindrical tube 4 should be broken for some reason, small fragments of the broken cylindrical tube 4 don't fly out into the surrounding area, thus increasing the safety of the heating apparatus.

Figure 7:
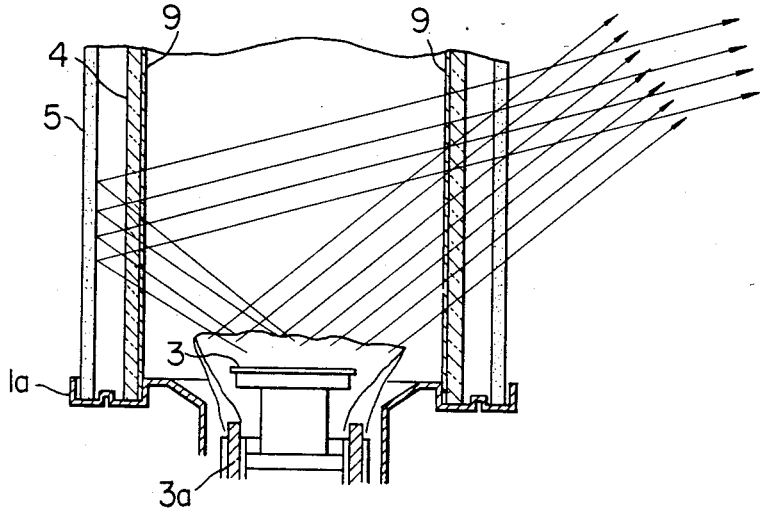
FIG. 7 is an enlarged longitudinal sectional view showing essential parts of a heating apparatus according to still another preferred embodiment of the present invention.

FIG. 7 shows still another embodiment of the present invention, in which a thin metal reflection film 9 such as a tin film is coated on at least the inner surface of the cylindrical tube 4. According to this embodiment, images of the burning flame, which are produced with reflections at the inner surface of the cylindrical tube 4, are not only increased in the number thereof, but also luminous in different colors such as red, purple, blue and others, thereby a brighter illuminating effect can be obtained in combination with the speckled patterns as stated above.

Figure 2:
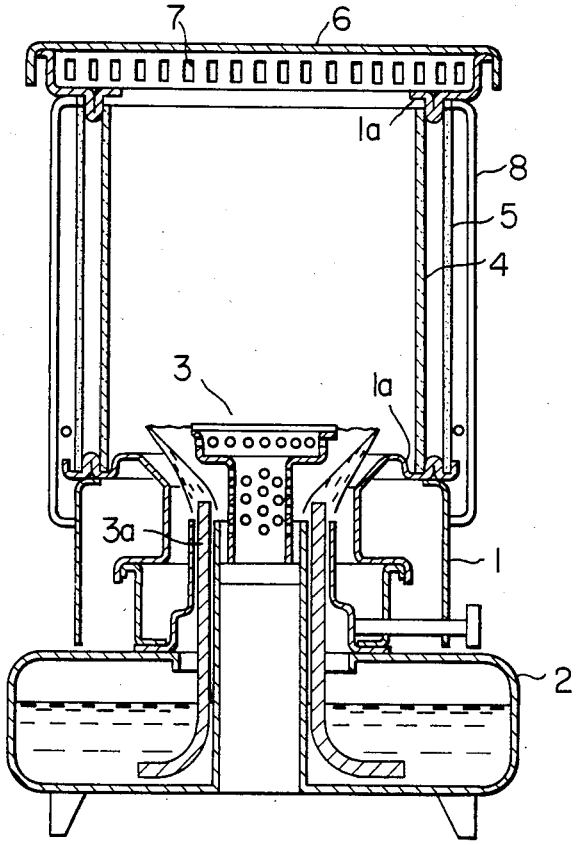
FIG. 2 is a longitudinal sectional view of the heating apparatus in FIG. 1.
Figure 3:
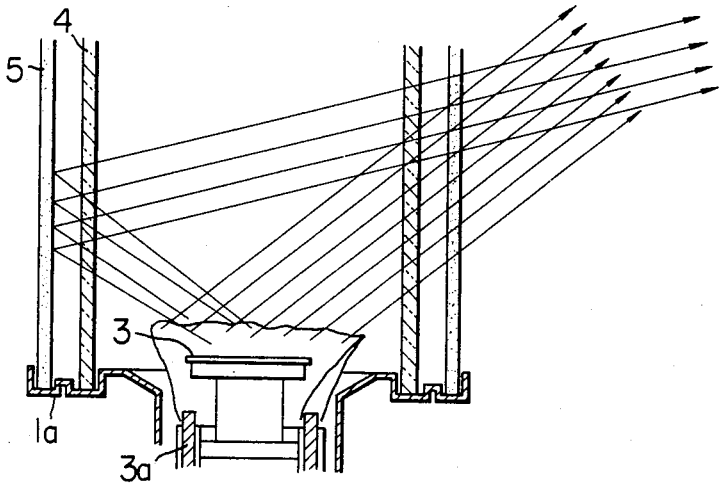
FIG. 3 is an enlarged longitudinal sectional view showing essential parts of the heating apparatus in FIG. 1.
Figure 4:
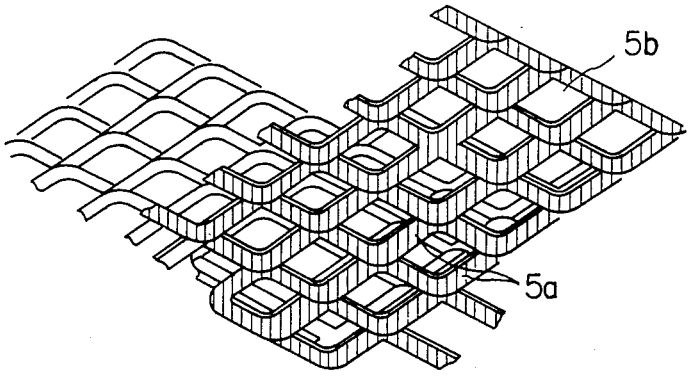
FIG. 4 is a view for explaining the operation of the heating apparatus in FIG. 1.

In this connection, although various materials such as a wire net, a punch plate with minute holes or a heat resistant fiber net other than the aforesaid lath net may be utilized as the net-like member 5, any material used has to meet the requirement that it produces speckled patterns when overlapped. The meshes of the net-like member are preferably formed to have a size of 2–30 mesh. Moreover, since the net-like member 5 is susceptible to thermal contraction, it is desired that the net-like member 5 is loosely supported by forming grooves 1*a* in the cover 6 and the heater body 1, for instance, as shown in FIG. 2. It is also preferable in the illustrated embodiments including the cylindrical member 4 that the net-like member 5 and the cylindrical tube 4 are separately fitted in consideration of that they have different coefficients of thermal contraction from each other. Moreover, the net-like member 5 may be provided at either one of the inner and outer sides of the cylindrical tube 4 in the illustrated embodiments including the cylindrical tube 4. Although various methods are possible as means for detachably fitting the net-like member 5, it can be easily attached or removed by such an arrangement, for instance, that a part of the net-like member 5 is cut out in the longitudinal direction and one of the vertical edges is freely abutted on the other vertical edge, the net-like member 5 being removed by releasing the abutted vertical edges.

A convection type oil heater having the combustion portion 3 as a heat source has been described in the abovementioned embodiments. However, the present invention is applicable to other heaters using a gas burner or an electric heater as a heat source. The heating type is also not limited to the convection type but any other type heater including a reflection type heater can be used. In addition, the combustion portion 3 is not necessarily shaped into a circular form as illustrated in the embodiments and may be of a flat surface type. In this case, two sheets of net-like members 5 are placed at the front of the combustion portion having the flat surface to be overlapped one above the other, whereupon there is obtained a similar effect to that in the embodiments as stated above.

As fully described hereinbefore by way of the preferred embodiments, a heating apparatus according to the present invention makes it possible to perform mixed heating with the combination of direct radiant heat and indirect radiant heat, thus providing comfortable and effective heating. Furthermore, light from a heat source is radiated through mesh openings of a net-like member and hence are properly divided into small fragments of light flux, whereby the emitted light gives a soft feeling to the user's eyes. Particularly, according to the present heating apparatus, a speckled pattern of light is produced by virtue of the net-like member and the thus produced speckled pattern shines brightly over the entire surface of the net-like member, thus providing a pleasant mood from the heating apparatus.

We claim:

1. A heating apparatus comprising:

a combustion portion for forming a flame for generating heat and light;

an at least partially transparent cylindrical tube surrounding an outer periphery of said combustion portion; and a cylindrical net-like member having a highly reflective mirror-like inner surface disposed on at least one of an outside and an inside of said cylindrical tube, said net-like member being disposed at a location spaced from said flame whereby it is prevented from making contact with said flame, and being made of 2 to 30 mesh lath net, a speckled pattern being visible when viewed along a horizontal direction from outside said apparatus by a combination of (i) light which passes through mesh frames of said net-like member on one side of said net-like member directly from said combustion portion and (ii) reflected light which is reflected by said highly reflective mirror-like inner peripheral surface of said net-like member on an opposite side of said net-like member and which then passes through said mesh frames on said one side, said mirror-like surface being oriented to reflect light from said combustion portion at an angle relative to said net-like member which is different from an angle of incidence relative to said net-like member light passing through said net-like member being visually overlapped when viewed during operation along a horizontal direction from outside said apparatus.

2. A heating apparatus according to claim 1, wherein said netlike member is made of a member having rhomboid mesh frames as a lath net.

3. A heating apparatus according to claim 1 or 2, wherein said netlike member is electroplated with chromium.

4. A heating apparatus according to claim 1 or 2, wherein said netlike member is fitted in said heating apparatus in a detachable and reversible manner.

5. A heating apparatus according to claim 1 wherein said netlike member is embedded into said at least partially transparent cylindrical tube.

6. A heating apparatus according to claim 1 wherein at least partially transparent inner and outer cylindrical tubes are disposed at the inner and outer sides of said netlike member, respectively.

7. A heating apparatus as in claim 1, wherein an outer surface of said lath net is treated to provide a reflecting surface.

* * * * *